United States Patent [19]

Louie et al.

[11] Patent Number: 4,990,242

[45] Date of Patent: Feb. 5, 1991

[54] ENHANCED SULFUR REMOVAL FROM FUELS

[75] Inventors: Stephen Louie, Kingwood, Tex.; Gerald E. Markley, Baton Rouge, La.

[73] Assignee: Exxon Research and Engineering Company, Florham Park, N.J.

[21] Appl. No.: 366,067

[22] Filed: Jun. 14, 1989

[51] Int. Cl.[5] ..... C10G 23/02

[52] U.S. Cl. ..... 208/218; 208/211; 208/80; 208/78; 208/213

[58] Field of Search ..... 208/218, 211, 213, 80, 208/78

[56] References Cited

U.S. PATENT DOCUMENTS

| | | | |
|---|---|---|---|
| 2,892,774 | 6/1959 | Porter et al. | 208/218 |
| 2,927,891 | 3/1960 | Weikart | 208/218 |
| 2,938,857 | 5/1960 | Johnson et al. | 208/218 |
| 3,050,457 | 8/1962 | Wilson | 208/211 |
| 3,607,723 | 9/1971 | Peck et al. | 208/59 |
| 3,671,420 | 6/1972 | Wilson et al. | 208/61 |
| 3,691,152 | 9/1972 | Nelson et al. | 208/218 |
| 3,830,731 | 8/1974 | Reed, Jr. et al. | 208/211 |
| 3,843,508 | 10/1974 | Wilson et al. | 208/76 |
| 3,902,991 | 9/1975 | Christensen et al. | 208/211 |
| 4,006,076 | 2/1977 | Christensen et al. | 208/211 |
| 4,062,762 | 12/1977 | Howard et al. | 208/211 |

*Primary Examiner*—Helane E. Myers
*Attorney, Agent, or Firm*—Chris P. Konkol

[57] ABSTRACT

An enhanced process to reduce the sulfur content in petroleum distillate products through fractionation of a feedstock followed by segregated hydrotreating. Improved performance and more controlled desulfurization is achieved.

15 Claims, 3 Drawing Sheets

ENHANCED SULFUR REMOVAL FROM FUELS

BACKGROUND OF THE INVENTION

This invention relates to hydrotreating a petroleum distillate. More particularly, this invention relates to a hydrotreating process comprising a plurality of hydrotreating zones operating at distinct operating conditions.

Refiners, to compete in the marketplace, have continuously sought to improve the quality of mid-distillate products while at the same time reducing processing costs. In the past few years, refiners have tended to shift away from the construction of new equipment for upgrading poorer stocks to the maximizing of existing equipment in order to achieve the desired upgrades. This has become a continual challenge to refiners as not only have stocks become heavier and generally poorer in quality, but also the threat of more stringent mandates on emissions and other burning qualities has further strained available upgrading capacity.

Regulations limiting the quantity of sulfur in distillate products are in effect in most parts of the world. The Environmental Protection Agency (EPA) on the federal level and various state agencies such as the California Air Resources Board (CARB) have envisioned more stringent standards for the future (0.05 wt % sulfur by 1994). The control of sulfur in refinery products is presently accomplished through hydrotreatment of full boiling range distillates to reach the sulfur specifications. The present invention describes a method to enhance the performance of hydrotreaters to remove more sulfur.

To better understand and appreciate the present invention, it is helpful to point out some of the limitations and drawbacks of current hydrotreating configurations. A hydrotreater typically consists of a single unit receiving feed from a single source, processing it to a single set of product quality specifications, and discharging it to usually a single end product. This simple type of system suffers from many limitations and inefficiencies. First of all, every molecule experiences the same nominal residence time in the reactor, without regard to its product quality deficiencies. Conceptually, this results in the over-treating of molecules already at or near product quality targets, while it results in underprocessing of difficult molecules to achieve a product which, on balance, is of acceptable quality. In the case of sulfur removal, much more desulfurization occurs at the inlet end of the reactor zone where easy mercaptans and thiophenes are reacting versus at the back of the bed where the harder benzothiophene species are reacting. Thus, the back of the bed is capable of removing more tons of sulfur per day if the concentration of easy sulfur species could be increased in the back of the reactor, for example, by increasing throughput. An analogous situation exists between olefin saturation and aromatics saturation for cetane improvement of the product. Olefin saturation occurs relatively easily near the front of the bed, while aromatics saturation is more difficult. In typical hydrotreating systems, lighter fractions with their olefins already saturated must ride through the back of the catalyst bed, thereby depriving the aromatics of important residence time needed to saturate rings and unnecessarily diluting the concentration of aromatics.

Secondly, with the uniform residence time for all molecules in a conventional hydrotreating design, less than optimal utilization of hydrogen occurs. After easy fractions have met product specifications in the front of the bed, they continue to absorb more hydrogen until they exit the catalyst bed.

Thirdly, because the product and its specifications are considered in total, it is difficult to take advantage of segregations in product qualities throughout the boiling range as they may exist. For example, the lighter cuts may be substantially free of heteroatoms, making them an acceptable higher valued product or feedstock for another catalyst which is sensitive to heteroatoms such as sulfur or nitrogen. Alternatively, cetane in the heavier cuts may be significantly higher than in the overall stream, reducing the need for premium streams as corrector stocks. The typical hydrotreating unit makes no attempt to sort hydrotreated molecules into different product classifications according to properties.

The combination of a hydrotreater and a fractionator or simple separation stage in an integrated process is generally known. For example, U.S. Pat. No. 3,806,444; U.S. Pat. No. 4,179,355; and U.S. Pat. No. 4,179,354 individually disclose separating the effluent from a hydrotreater as part of a process to increase the efficiency of sulfur removal. When treating heavy oils, a distillation tower may be used to dewax, as shown in U.S. Pat. No. 4,592,828. Both U.S Pat. No. 4,655,903 and 3,726,787 employ a distillation column as part of a process to remove polynuclear aromatics from the product when treating heavy oil feeds.

It is conventional to employ more than one reactor or reaction zones in a hydrotreating process. U.S. Pat. No. 3,728,249 to Antezano discloses two hydrotreaters in series, in which case at least a part of the feed passes through the second hydrotreating zone. The total composition of the feedstock to each of the zones necessarily differs. U.S. Pat. Nos. 3,607,723 Peck et al., 3,671,420 to Wilson et al., and 3,843,508 to Wilson et al. individually relate to split flow hydrodesulfurization in which there is an in-situ separation of the feedstock, and in which the two hydrotreating zones are intercommunicating sections of a column. A disadvantage of this approach is that essentially the same conditions, such as temperature and pressure in both hydrotreating zones are mandated by this arrangement. Also, the space velocities through each zone cannot be independently tailored.

BRIEF DESCRIPTION OF THE INVENTION

This invention teaches a method of enhancing a hydrotreating process to reduce the sulfur content in a petroleum distillate feedstock through fractionation of the feedstock followed by segregated hydrotreating. Improved performance and more controlled desulfurization is achieved.

BRIEF DESCRIPTION OF THE DRAWINGS

The process of the present invention will be more clearly understood upon reference to the detailed discussion below upon reference to the drawings wherein.

DETAILED DESCRIPTION OF THE INVENTION

Figure 1:
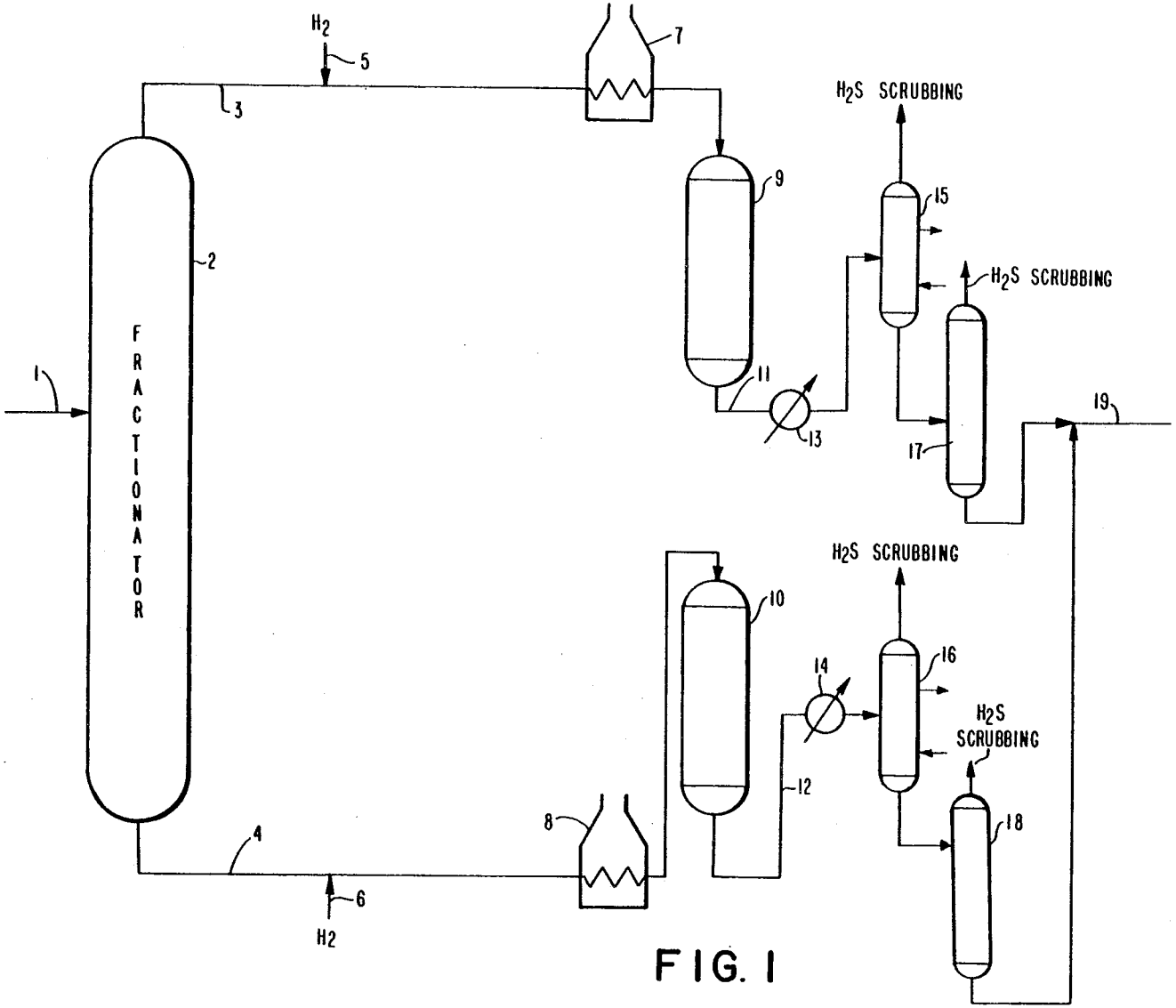
FIG. 1 shows a schematic diagram of one embodiment according to this invention where parallel hydrotreating units treat different fractions from a fractionator.

The present invention relates to an improved process for hydrotreating petroleum distillate feedstocks comprising:

(1) splitting the feedstock by fractionation into at least two different boiling point fractions, including a first (top) distillate stream relatively depleted in sulfur and a second (lower) distillate stream relatively concentrated in sulfur;

(2) hydrotreating in a first hydrotreater zone, the first distillate stream in admixture with an excess of hydrogen to obtain a first zone effluent; and (3) hydrotreating in a second hydrotreating zone the second distillate stream in admixture with an excess of hydrogen to obtain a second zone effluent;

whereby a greater operating severity and hydrogen consumption per barrel occurs in the second hydrotreating zone than in the first hydrotreating zone.

Preferred embodiments employ parallel hydrotreating zones where the pressure in the first hydrotreating zone is relatively lower than the pressure in the second hydrotreating zone. Alternatively or additionally, the hydrotreating zones may be operated at different temperatures or different residence times in order to effect the necessary variation in operating severities between the hydrotreating zones. A single hydrotreating zone may be employed by alternating the feed thereto. It will be understood by those skilled in the art that a plurality of hydrotreaters greater in number than two may analogously be employed.

A primary advantage of employing a plurality of hydrotreating zones according to the present invention is that hydrogen consumption is lowered to a greater extent than expected. In comparison to a single high pressure hydrotreating zone achieving about the same product sulfur level, the present process consumes dramatically less hydrogen, typically about half the hydrogen. In comparison to a single low pressure hydrotreating zone, the present process achieves a lower product sulfur level at lower hydrogen consumption. Subject to available equipment or capital expeditures, even greater sulfur reductions may be obtained by increasing the number of hydrotreating zones and fractions thereto.

In the following description of the invention, the term "petroleum distillate feed or feedstream" is meant to include virgin petroleum feedstock or a distillate thereof. Materials which may be advantageously treated include light catalytic cracker oil (LCCO), which has a substantial amount of aromatics or thermally cracked distillates such as a coker distillates.

The term "hydrogen containing gas" as used herein includes by definition substantially pure hydrogen, for example 90 to 97 percent by volume $H_2$, or a recycle hydrogen stream recovered subsequently in a process and containing at least 40 percent by volume hydrogen, or a hydrogen rich gas as elsewhere obtained from the processing of hydrocarbonaceous fuels and containing at least 40 percent by volume hydrogen.

Although the term "fractionator" is used herein, those skilled in the art will appreciate that this encompasses a distillation column or alternatively a high pressure separator, equivalent to a one plate distillation unit.

Referring to FIG. 1, a petroleum distillate feedstream comprising for example virgin naphtha, enters fractionator 2, which produces two streams for processing in parallel hydrotreaters. Although the split stream embodiment shown in the FIG. 1 is simpler, it will be appreciated that additional streams may be produced by the fractionator, for example, depending on the composition of the feedstock or distribution of total sulfur or individual sulfur types throughout its boiling range.

In the case where two streams are hydrotreated in parallel, the fractionator 2 produces a first (top) distillate stream 3, suitably a 350/575° F. fraction, representing 30 to 95 percent by weight of the feed or total distillate product, preferably 50 to 90 percent and most preferably 60 to 80 percent of the feed. A second (lower) distillate stream 4 is suitably a 575/700° F. distillate, representing 5 to 70 percent, preferably 10 to 50 percent of the feed, and most preferably 20 to 40 percent of the feed.

The distillate streams are introduced into a plurality of, in this case two, parallel hydrotreaters 9 and 10. Before being passed to the hydrotreaters, the feedstock fractions are typically mixed with hydrogen containing gas streams 5 and 6 and heated to a reaction temperature in furnaces 7 and 8, respectively, as in itself is conventional and will be understood by those skilled in the art. The hydrogen-containing feedstock fractions 3 and 4 preferably pass downward through the reactors 9 and 10. Depending on the feedstock and operating conditions, all of the oil may be vaporized or as much as 80–90% may remain in the liquid phase.

Advantageously, current hydrotreating facilities may be retrofitted, by using an existing hydrotreater as the higher pressure hydrotreater and installing a spare or new hydrotreater as the lower pressure hydrotreater. A lower pressure hydrotreater, having relatively thinner walls, is normally substantially less expensive in terms of construction and materials costs.

The catalysts used in this improved hydrotreating process are of a conventional nature. Without being limited to any particular catalyst, typical catalysts are in the form of extrudates and include molybdena on alumina, cobalt molybdate on alumina, nickel molybdate on alumina, nickel tungstate or combinations thereof. Catalyst choice may depend on the particular application. Cobalt molybdate catalyst is generally used when sulfur removal is the primary interest. The nickel catalysts find application in the treating of cracked stocks for olefin or aromatic saturation. One preferred application for molybdena catalyst is sweetening or the removal of mercaptans. The preparation of these catalysts are now well known in the art.

Various types of reactions occur during hydrotreating. In one type of reaction, the mercaptans, disulfides, thiophenes, and benzothiophenes and dibenzothiophenes are desulfurized. The mercaptans and disulfides are representative of a high percentage of the total sulfur in lighter virgin oils, such as virgin naphtha and heating oil. Thiophenes, benzothiophenes and dibenzothiophenes appear as the predominant sulfur form in heavy virgin oils and even more in cracked stocks of all boiling ranges.

Figure 3:
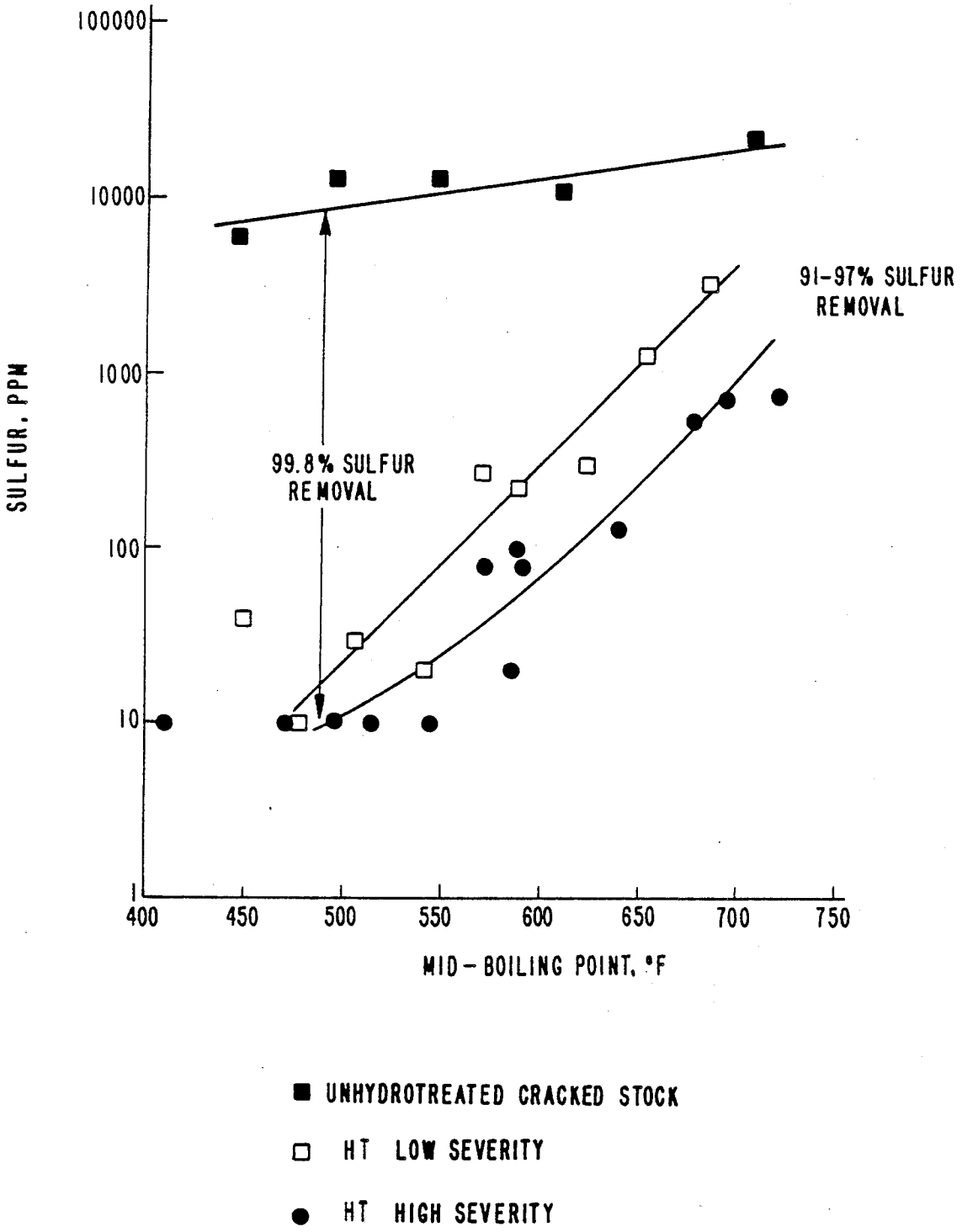
FIG. 3 contains a graph illustrating the sulfur distribution in the full boiling range distillate before and after conventional hydrotreating.

Although the hydrotreater desulfurization targets are determined by the sulfur specifications, the degree of difficulty of desulfurization varies with the boiling point of the distillate. Lower boiling fractions are desulfurized more readily than higher boiling fractions. The sulfur compounds which are present in the lower boiling fractions are sulfides, thiophenes, and benzothiophenes which are easier to remove than the dibenzothiophenes in the higher boiling fractions. Hence, hydrotreatment of the full boiling range distillate as a single stream, as in current practice, tends to result in overdesulfurization of the light fraction and under desulfurization of the heavy fraction. In a conventional hydrotreating process, the 425° F.− portion of a full boiling range distillate may achieve 99% desulfurization, while the 700° F.+ portion may achieve less than 92% desulfurization. Typical sulfur distributions before and after hydrotreating are shown in FIG. 3.

In the split stream embodiment shown in FIG. 1, the two hydrotreaters 9 and 10 differ in their severity of operating conditions. In general, it is preferred that the bottom hydrotreater 10 be a moderate to high pressure hydrotreater with potentially greater residence time and the top hydrotreater 9 operate at a relatively lower pressure and potentially shorter residence time. Suitably, the top hydrotreater 9 will function at a total pressure of 100 to 250 psia, preferably 100 to 200 psia, with a hydrogen partial pressure of about 40 to 200 psia. The bottom hydrotreater 10 will operate at a pressure of about 100 to 800 psia, preferably about 250 to 500 psia, with a suitable hydrogen partial pressure of 40 to 500 psia. The ratio of the total pressure of hydrotreater 9 to hydrotreater 10 is suitably in the range of 1:2 to 1:10, preferably about 1:3 to 1:5.

Instead of or in addition to relying on pressure for varying the severity of the hydrotreating zones, other processing conditions may be adjusted accordingly. In general, higher temperature may be used to produce greater severity in one hydrotreating zone, but will be unnecessary in a second hydrotreating zone since high temperature tends to deactivate the catalyst and shorten its lifetime between regenerations. A temperature differential between hydrotreating zones of 0 to 200° F. is suitable, preferably 50° to 100° F.

The temperature in the hydrotreaters is suitably over 500° F., preferably 600° to 800° F. Temperatures over 800° F. are not recommended, since catalyst deactivation and undesirable reforming reactions or aromatics production may occur. Temperatures are varied to meet distillate specifications. As the cycle length is prolonged, the temperature is typically increased, with the temperature typically highest at the end of the run.

A difference in residence times between different hydrotreaters may be employed as well according to the present process. The ratio of residence times between the hydrotreaters is suitably 1.5:1 to 6:1 preferably 2:1 to 4:1. The high severity hydrotreater may have an LHSV (liquid hourly space velocity, or volumetric flow of liquid per volume of catalyst per hour) of 0.2 to 1.5, preferably 0.3 to 1.0. The relatively low severity hydrotreater suitably may have an LHSV of 0.8 to 6, preferably 1 to 4.

The ratio of feed rates to the two hydrotreaters 9 and 10 differs depending ideally on processing requirements for the various streams or the relative reactivity of the different stream. For example, if the lighter fraction contains very reactive sulfur species and low concentrations of sulfur, it would be advantageous to raise its endpoint somewhat and treat the stream at a much greater feed rate relative to the heavier fraction. Typically, the ratio of the LHSV (liquid hourly space velocity, or volumetric flow of liquid per volume of catalyst per hour) of the relatively high pressure hydrotreater to the relatively low pressure hydrotreater is 1.5:1 to 6:1, preferably about 2:1 to 4:1, on account of the more refractory sulfur compounds tending to concentrate in the heavier fractions.

The relatively low pressure hydrotreater will consume considerably less hydrogen per barrel than the high pressure hydrotreater, suitably 50 to 500 SCF/B, preferably about 100 to 400 SCF/B, compared to a consumption of 200 to 1000 SCF/B, preferably 200 to 900 SCF/B in the high pressure hydrotreater. The effluent from the low pressure hydrotreater will be depleted in sulfur, to below 0.05 percent or less sulfur and frequently to below 0.01 percent sulfur. The effluent from the high pressure hydrotreater will be depleted to a lesser extent, usually to less than 0.3 wt % sulfur. The two effluent streams, in the preferred embodiment, are pooled, in which case the average sulfur level on the combined streams are within the limitations of current environmental standards. The effluent in the present invention should preferably have a sulfur content of less than 0.05 percent or 500 ppm.

The effluents 11 and 12 from the hydrotreaters 9 and 10, respectively, are typically cooled in heat exchangers 13 and 14 and passed to gas-liquid separators 15 and 16, respectively. A portion may be recycled (not shown) to the feedstreams 3 and 4 and the hydrotreaters for retreatment. The recycled gas is usually first passed through a conventional scrubber (not shown) to remove the hydrogen sulfide. This is done because of the inhibiting effect of hydrogen sulfide on the kinetics of hydrotreating and also to reduce corrosion in the recycle circuit. Sometimes, when treating a light stock with a very low sulfur content, the recycle gas is not scrubbed because the hydrogen sulfide ($H_2S$) is at an acceptably low level.

Subsequent to the gas-liquid separators 15 and 16, the liquid effluents are typically passed to strippers 17 and 18, respectively, to remove residual $H_2S$ and other light gases; then they may be fractionated into several cuts. In many cases, the liquid products are given a light caustic wash to assure complete removal of $H_2S$. Small quantities of $H_2S$, if left in the product, will oxidize to elemental sulfur upon exposure to air, and will cause the product to exceed pollution or corrosion specifications.

Subsequent to the above mentioned process steps, the combined effluent stream 19 may be introduced into an optional second stage fractionator (not shown). Advantageously, the hydrotreaters and second stage fractionator are linked in tandem such that the products from the second stage fractionator can be sent back to a hydrotreating zone individually or in part based on the qualities which vary with boiling range, for example, gravity, cetane, color and heteroatom content. Such an arrangement gives the refinery options to further vary the amount of hydrotreating that each fraction is exposed to and also the opportunity to alter the cutpoints of hydrotreated effluents. Different fractions can be sent to make-up different products or serve as feedstocks to different processes, depending on the product quality.

Figure 2:
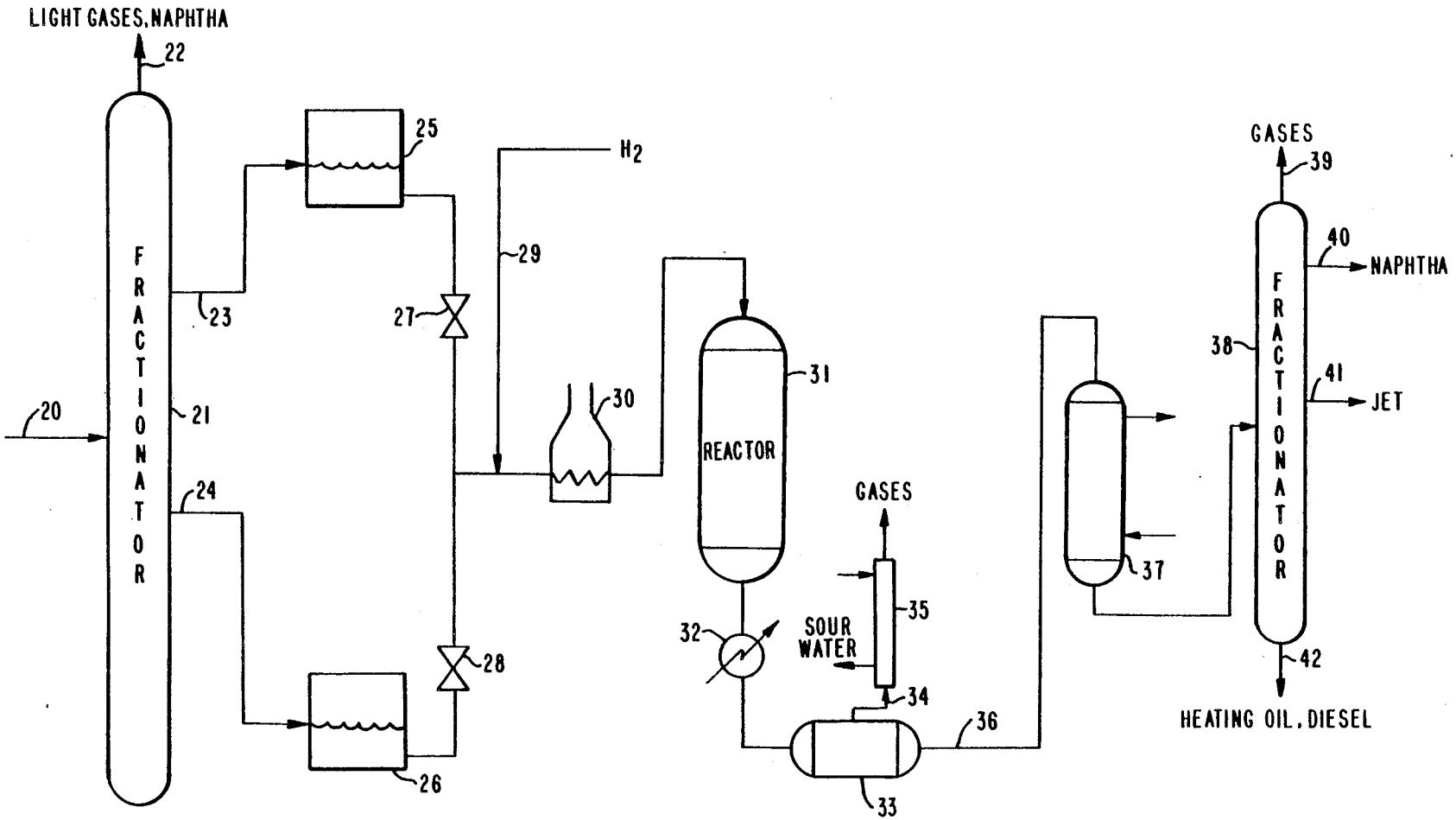
FIG. 2 shows a schematic diagram of a second embodiment of the invention where the same hydrotreating unit is used to treat separate fractions alternatively and the fractions are treated at different severities.

Referring now to FIG. 2, a second embodiment of the present process is shown, wherein a petroleum distillate is hydrotreated in a "blocked" operation in which different streams are alternatively passed through the same hydrotreating unit operating under different conditions. A petroleum distillate feedstream 20 enters fractionator 21, which among other products, produces a light gases/naphtha stream 22, a light distillate stream 23, and a heavy distillate stream 24. The light and heavy distillate streams may be characterized by the same boiling point ranges given for the first and second distillate streams described above with respect to the first embodiment shown in FIG. 1.

Each of the distillate streams 23 and 24 enters temporary storage vessels or tanks 25 and 26, respectively. Tanks 25 and 26 each preferably has a level control device for maintaining the level of liquid in the tank responsive to surges or changes in the rate of input or output streams. Each of the tanks alternatively supplies at preselected, timed intervals a feed via valves 27 and 28, respectively, to the hydrotreater reactor 31, after adding hydrogen 29 to the feed and heating the admixture in furnace 30. The alternate feeding of light distillate stream 23 and heavy distillate stream 24 can be routinely accomplished utilizing conventional valving and process control equipment, as will be readily appreciated by those skilled in the art. The different operating conditions or severities under which each of streams 23 and 24 are treated in the hydrotreating reactor 31 correspond to the different conditions in the two hydrotreaters described with respect to the first embodiment. In general, the severity under which the heavy distillate stream is subjected to in the hydrotreater reactor 31 is greater than the severity to which the lighter distillate stream is subjected. Specifically, the different pressure, temperature and space velocity ranges at which the light and heavy distillate streams are respectively treated and the ratio of the different operating parameters correspond to the operating conditions or parameters described above with respect to the two different hydrotreaters in the first embodiment and need not be repeated here. The effluent from the hydrotreater reactor 31 is passed through a heat exchange means 32 to cool the product. The cooled product is then introduced into a gas-liquid separator 33 yielding a gas stream 34 which may be treated in scrubber 35 to remove hydrogen sulfide. Typically, the degassed effluent stream 36 is sent to a stripper 37 to remove any residual hydrogen sulfide and subsequently introduced into a second fractionator 38. The latter fractionator may produce a menu of product streams, for example, a top gas stream 39, a naphtha stream 40, a jet fuel stream 41, and a bottoms heating oil/diesel stream 42.

COMPARATIVE EXAMPLE 1

For comparison to the present process, a conventional hydrotreating process was carried on a full range 350/700° F. light catalytic cycle oil (LCCO) from a catalytic cracking unit, the oil having a sulfur concentration of 1.55% and the following characteristics:

| | |
|---|---|
| Sulfur, wt % | 1.55 |
| Gravity, API | 12.7 |
| Total Nitrogen, ppm | 493 |
| Basic Nitrogen, ppm | 42 |
| Pyrrole Nitrogen, ppm | 28.0 |
| Aniline Pt., °F. | <30.0 |
| Carbon, wt % | 89.17 |
| Hydrogen, wt % | 9.03 |
| Hydrogen by NMR, wt % | 9.01 |
| Freeze Point, °F. | −22.2 |
| Cloud Pt., °F. | 0.0 |
| Bromine Number | 20.0 |
| Refractive Index, 20° C. | 1.5765 |
| GCD, °F. | |
| IBP/5 | 321/449 |
| 10/20 | 458/492 |
| 30/40 | 503/528 |
| 50/60 | 548/578 |
| 70/80 | 608/638 |
| 90/95 | 669/688 |
| 99.5 | 735 |
| Composition, LV % | |
| Saturates | 19.9 |
| Total Aromatics | 80.1 |
| 1 − Ring Aromatics | 11.1 |
| 2 − Ring Aromatics | 51.3 |
| 3 + Ring Aromatics | 17.7 |

This oil was introduced into a pilot scale hydrotreater consisting of a single 1" diameter reactor housing 240 cc of extrudate catalyst and operating at a temperature of 625° F., a pressure of 300 psig, a space velocity of 1.0 LHSV, and a treat gas rate of 1000 SCF/B pure hydrogen. The hydrotreater contained RT-3 CoMo catalyst commercially available from American Cyanamid. Hydrogen gas was consumed at the rate of 535 SCF/B. The product of the hydrotreater contained 0.20% sulfur. The results of this example are summarized in Table I under the heading FULL RANGE HYDROTREATING.

EXAMPLE 2

The same feed, catalyst and apparatus as in comparative example 1 above were employed, except that the hydrotreater feed was split into a 570° F.− and 570° F.+ light and heavy fractions representing 68% and 32% of the feed, respectively. The light fraction contained 1.1% sulfur and the heavy fraction contained 1.7% sulfur. In the relatively higher pressure first hydrotreater (identical to the one in comparative example 1) the temperature was 625° F., the pressure 300 psig and the space velocity 0.3 LHSV. The second hydrotreater was identical to the first hydrotreater but operated at a lower pressure of 100 psig, a temperature of 625° F. and a space velocity of 1.4 LHSV. According to the principles of this invention, the light fraction was hydrotreated in the second hydrotreater while the heavy fraction was treated in the first hydrotreater. The hydrogen consumption in the second hydrotreater operating on the light distillate was 300 SCF/B and in the first hydrotreater operating on the heavy distillate was 695 SCF/B. The effluent from the first hydrotreater had a sulfur content of 0.16% and the effluent from the second hydrotreater had a sulfur content of 0.002%. Combining the first and second effluents, a quality diesel fuel stream was obtained having a 0.06% sulfur content. The average hydrogen consumption was 425 SCF/B. The results of this example are summarized in Table I under the heading SEGREGATED HYDROTREATING, 570° F. CUTPOINT. As shown in the table, much greater hydrodesulfurization was obtained according to the present process than by hydrotreating the full-boiling range feed (comparative example 1 above). Nearly four times the catalyst volume at 300 psig would have been necessary in order to reach 0.06 wt % sulfur without feed splitting.

EXAMPLE 3

The same feed, catalyst and apparatus as in example 2 above were employed, except that the hydrotreater feed was split into 620° F.[31] and 620° F.+light and heavy fractions representing 84% and 16% of the feed, respectively. The light fraction contained 1.1% sulfur and the heavy fraction contained 2.2% sulfur. In the relatively higher pressure first hydrotreater, the temperature was 625° F., the pressure 300 psig and the space velocity 0.2 LHSV. The second hydrotreater which was identical to the first, operated at a lower pressure of 100 psig, a temperature of 625° F. and a space velocity of 1.7 LHSV. Again, according to principles stated above, the light fraction was hydrotreated in the second hydrotreater while the heavy fraction was hydrotreated in the first hydrotreater. The hydrogen consumption in the second hydrotreater was 240 SCF/B and in the first hydrotreater was 805 SCF/B. The effluent from the first hydrotreater had a sulfur content of 0.29% and the effluent from the second hydrotreater had a sulfur content of 0.07%. Combining the first and second effluents, a diesel fuel quality stream was obtained having a 0.10% sulfur content. The average hydrogen consumption was 330 SCF/B. The results of this example are summarized in Table I below under the heading SEGREGATED HYDROTREATING, 620° F. CUTPOINT. As shown in the table, significantly superior performance was obtained relative to comparative example 1 above.

TABLE I

| | Full Range Hydrotreating | Segregated Hydrotreating 570° F. Cutpoint 68% Front | 570° F. Cutpoint 32% Back | 620° F. Cutpoint 84% Front | 620° F. Cutpoint 16% Back |
|---|---|---|---|---|---|
| Feed Sulfur, Wt % | 1.3 | 1.1 | 1.7 | 1.1 | 2.2 |
| HT Conditions | | | | | |
| Pressure | 300 | 100 | 300 | 100 | 300 |
| LHSV | 1.0 | 1.4 | 0.3 | 1.7 | 0.2 |
| Product Sulfur, Wt % | 0.2 | 0.002 | 0.16 | 0.07 | 0.29 |
| Total | 0.2 (Base) | 0.06 (30%) | | 0.10 (50%) | |
| $H_2$ Consumption, SCF/B | 535 | 300 | 695 | 240 | 805 |
| Total | 535 (Base) | 425 (80%) | | 330 (62%) | |

Having now fully described our invention in several embodiments and examples, various modifications and changes for accomplishing the same ends by substantially similar means will occur to those skilled in the art. However insofar as such modifications and changes are within the spirit and scope of the appended claims, they are deemed part of the invention.

What is claimed is:

1. A process for hydrotreating a petroleum distillate feedstock in a plurality of hydrotreating zones, comprising:

(1) splitting the feedstock by fractionation into at least two different boiling point fractions, including a first distillate stream relatively depleted in sulfur and a second distillate stream relatively concentrated in sulfur, wherein said first distillate stream boils in the range of 350° to 575° F. and said second distillate stream boils in the range of 575°to 700° F.;

2) hydrotreating in a first hydrotreating zone the first distillate stream in admixture with an excess of hydrogen to obtain a first effluent; and (3) hydrotreating in a second hydrotreating zone, the second distillate stream in admixture with an excess of hydrogen to obtain a second effluent;

wherein the first hydrotreating zone is at a total pressure of 100 to 250 psia and the second hydrotreating zone is at a total pressure of 100 to 800 psia and the ratio of total pressure in the first hydrotreating zone to the total pressure in the second hydrotreating zone is in the range of about 1:2 to 1:8 and whereby a greater hydrogen consumption per barrel occurs in the second hydrotreating zone than in the first hydrotreating zone.

2. The process of claim 1, wherein the temperature in the first hydrotreating zone is relatively lower than the pressure in the second hydrotreating zone.

3. The process of claim 1, wherein the hydrotreating zones are parallel.

4. The process of claim 1, wherein the first distillate stream and the second distillate stream are alternately fed into a single hydrotreating means and the conditions in the hydrotreating means are changed to alter the severity to which each stream is subjected, the different conditions corresponding to different hydrotreating zones.

5. The process of claim 1, wherein the space velocity of said first stream in the first hydrotreating zone is relatively greater than the space velocity of the second stream to the second hydrotreating zone.

6. The process of claim 1, wherein the first stream represents 30 to 95 percent of the combined feed to the first and second hydrotreating zones and the second stream represents 5 to 70 percent of the combined feed.

7. The process of claim 1, wherein the first stream represents 60 to 80 percent of the combined feed to the first and second hydrotreating zones and the second stream represents 20 to 40 percent of the combined feed.

8. The process of claim 1, wherein the ratio of total pressure of the first hydrotreating zone to the second hydrotreating zone is in the range of about 1:3 to 1:5.

9. The process of claim 1, wherein the temperature is about 600° to about 800° F. in the first and second hydrotreating zones.

10. The process of claim 1, wherein the ratio of the space velocity in the first hydrotreating zone to the space velocity in the second hydrotreating zone is in the range of about 1.5:1 to 6:1.

11. The process of claim 1, wherein the hydrogen consumption in the first hydrotreating zone is about 50 to 500 SCF/B and the hydrogen consumption in the second hydrotreating zone is about 200 to 900 SCF/B.

12. The process of claim 1, wherein the effluent from the first hydrotreating zone is depleted in sulfur to a relatively greater extent than the effluent from the second hydrotreating zone.

13. The process of claim 8, wherein the sulfer content of the recombined total distillate product from the first and second streams is less than about 500 ppm.

14. A process for hydrotreating a petroleum distillate feedstock in a plurality of hydrotreating zones, comprising:

(b 1) splitting the feedstock by fractionation into at least two different boiling point fractions, including a first distillate stream relatively depleted in sulfur and a second distillate stream relatively concentrated in sulfur, wherein said first distillate stream boils in the range of 350° to 575° F. and the second distillate stream boils in the range of 575° to 700° F;

(2) hydrotreating in a first hydrotreating zone the first distillate stream in admixture with an excess of hydrogen to obtain a first effluent; and (3) hydrotreating in a second hydrotreating zone, parallel to said first hydrotreating zone, with the second distillate stream in admixture with an excess of hydrogen to obtain a second effluent;

wherein the first hydrotreating zone is at a total pressure of 100 to 250 psia and the second hydrotreating zone is at a total pressure of 100 to 800 psia and the ratio of total pressure in the first hydrotreating zone to the total pressure in the second hydrotreating zone is in the range of about 1:3 to 1:5 and whereby a greater hydrogen consumption per barrel occurs in the second hydrotreating zone than in the first hydrotreating zone.

15. A process for hydrotreating a petroleum distillate feedstock in a plurality of hydrotreating zones, comprising:

(1) splitting the feedstock by fractionation into at least two different boiling point fractions, including a first distillate stream relatively depleted in sulfur and a second distillate stream relatively concentrated in sulfur, wherein said first distillate stream boils in the range of 350° to 570° F. and said second distillate stream boils in the range of 575° to 700° F;

(2) hydrotreating in a first hydrotreating zone the first distillate stream in admixture with an excess of hydrogen to obtain a first effluent; and (3) hydrotreating in a second hydrotreating zone, the second distillate stream in admixture with an excess of hydrogen to obtain a first effluent;

wherein the first and second hydrotreating zones alternatively occupy the same hydrotreating means, and wherein the first hydrotreating zone is at a total pressure of 100 to 250 psia and the second hydrotreating zone is at a total pressure of 100 to 800 psia and the ratio of total pressure in the first hydrotreating zone to the total pressure in the second hydrotreating zone is in the range of about 1:3 to 1:5, and whereby a greater hydrogen consumption per barrel occurs in the second hydrotreating zone than in the first hydrotreating zone.

* * * * *